US009829245B2

(12) United States Patent
Chang et al.

(10) Patent No.: US 9,829,245 B2
(45) Date of Patent: Nov. 28, 2017

(54) NATURAL GAS LIQUEFACTION SYSTEM

(71) Applicant: KOREA ADVANCED INSTITUTE OF SCIENCE AND TECHNOLOGY, Daejeon (KR)

(72) Inventors: Daejun Chang, Daejeon (KR); Pal G Bergan, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 319 days.

(21) Appl. No.: 14/419,693

(22) PCT Filed: Dec. 7, 2012

(86) PCT No.: PCT/KR2012/010609
§ 371 (c)(1),
(2) Date: Feb. 5, 2015

(87) PCT Pub. No.: WO2014/025096
PCT Pub. Date: Feb. 13, 2014

(65) Prior Publication Data

US 2015/0226476 A1 Aug. 13, 2015

(30) Foreign Application Priority Data

Aug. 10, 2012 (KR) ..... 10-2012-0087533
Oct. 12, 2012 (KR) ..... 10-2012-0113541

(51) Int. Cl.
*F25J 1/00* (2006.01)
*F17C 5/04* (2006.01)
(Continued)

(52) U.S. Cl.
CPC ..... *F25J 1/0022* (2013.01); *F17C 5/04* (2013.01); *F17C 7/02* (2013.01); *F17C 13/00* (2013.01);
(Continued)

(58) Field of Classification Search
CPC ..... F25J 3/0231; F25J 3/0208; F25J 3/021; F25J 3/0216; F25J 3/0225; F25J 3/0279;
(Continued)

(56) References Cited

U.S. PATENT DOCUMENTS 4,901,533 A 2/1990 Fan et al.
5,613,373 A 3/1997 Grenier
(Continued)

FOREIGN PATENT DOCUMENTS

JP 3559283 8/2004
JP 2010189622 9/2010
(Continued)

OTHER PUBLICATIONS

International Search Report—PCT/KR2012/010609 dated Mar. 4, 2013.
(Continued)

*Primary Examiner* — Frantz Jules
*Assistant Examiner* — Brian King
(74) *Attorney, Agent, or Firm* — Cantor Colburn LLP

(57) ABSTRACT

Provided is a natural gas liquefaction system including a natural gas storage unit, a liquefied natural gas storage unit, body, a pumping unit, a sub-cooling unit, and a first distributing and conveying unit.

12 Claims, 7 Drawing Sheets

(51) Int. Cl.
*F17C 7/02* (2006.01)
*F17C 13/00* (2006.01)
*F04D 29/58* (2006.01)

(52) U.S. Cl.
CPC ..... *F25J 1/006* (2013.01); *F04D 29/5846* (2013.01); *F25J 2205/90* (2013.01); *F25J 2210/04* (2013.01); *F25J 2210/06* (2013.01); *F25J 2230/02* (2013.01); *F25J 2230/30* (2013.01); *F25J 2230/60* (2013.01); *F25J 2245/02* (2013.01)

(58) Field of Classification Search
CPC ..... F25J 3/0219; F25J 3/0221; F25J 2265/02; F25J 2210/04; F25J 2245/02
See application file for complete search history.

(56) References Cited

U.S. PATENT DOCUMENTS 5,956,971 A * 9/1999 Cole ..... F25J 1/0202 62/623
2008/0307827 A1* 12/2008 Hino ..... F25J 3/061 62/634
2009/0100844 A1* 4/2009 Rummelhoff ..... F25J 1/0288 62/48.2
2010/0147024 A1 6/2010 Roberts et al.
2010/0281915 A1 11/2010 Roberts et al.
2013/0139544 A1* 6/2013 Mak ..... F25J 1/0025 62/611

FOREIGN PATENT DOCUMENTS

KR 1020100120268 11/2010
KR 1020110079949 7/2011

OTHER PUBLICATIONS

Heo, et al., Efficient inorganic-organic hybrid heterojunction solar cells containing perovskite compound and polymeric hole conductors, Nature Photonics, 2013, pp. 486-491.

* cited by examiner

NATURAL GAS LIQUEFACTION SYSTEM

TECHNICAL FIELD

The present invention relates to a liquefaction system of gas or a gas mixture, and more particularly, to a natural gas liquefaction system.

BACKGROUND ART

A thermodynamic process of liquefying natural gas to produce liquefied natural gas (LNG) has been developed since the 1970s in order to satisfy various challenges including demands for higher efficiency and larger capacity. In order to satisfy these demands, that is, to increase efficiency and capacity of a liquefaction process, various attempts to liquefy natural gas using different refrigerants or different cycles have been continuously conducted up to now. However, the number of liquefaction processes that are practically used is very small.

One of the liquefaction processes that are being operated and have been most widely used is a 'propane pre-cooled mixed refrigerant process (or a C3/MR process)'. In the C3/MR process, supply gas is pre-cooled up to approximately 238 K by a multi-stage of propane (C3) Joule-Thomson (JT) cycle. The pre-cooled supply gas is liquefied and sub-cooled up to 123 K by heat exchange with a mixed refrigerant (MR) in a heat exchanger. Since the C3/MR process uses a refrigeration cycle using a single refrigerant and a refrigeration cycle using a mixed refrigerant, the liquefaction process is complex and it is difficult to operate the liquefaction system.

Another one of the successful liquefaction processes that are being operated is based on a cascade process by 'Conoco Phillips'. The liquefaction process of 'Conoco Phillips' consists of three Joule-Thomson cycles using methane C1, ethylene C2, and propane C3, which are pure-component refrigerants. Since the liquefaction process does not use the mixed refrigerant, there are advantages that an operation of the liquefaction process is safe, is simple, and is reliable. However, since each of the three cycles separately requires a compressor, a heat exchanger, and the like, there is a disadvantage that a size of the liquefaction system has no choice but to be increased.

Another one of the liquefaction processes that are being operated is a 'single mixed refrigerant process (or SMR process)'. In the SMR process, the supply gas is liquefied by heat exchange with the mixed refrigerant in a heat exchanging region. To this end, the SMR process uses a single closed loop refrigeration cycle using the mixed refrigerant. In the above-mentioned refrigeration cycle, after the mixed refrigerant is compressed and pre-cooled, the mixed refrigerant is condensed by the heat exchange in the heat exchanging region and is then expanded. The expanded refrigerant is again introduced into the heat exchanging region so as to condense the pre-cooled mixed refrigerant and liquefy the supply gas. The above-mentioned SMR process has an advantage that a system is compact due to a simple structure, but has a disadvantage in that efficiency of the liquefaction process is bad.

RELATED ART DOCUMENT

Patent Document

U.S. Pat. No. 4,901,533 A1 (Feb. 2., 1990)

DISCLOSURE

Technical Problem

An object of the present invention is to provide a natural gas liquefaction system capable of improving efficiency of a natural gas liquefaction process by heat exchange in which natural gas and liquefied natural gas are mixed with each other.

Technical Solution

In one general aspect, a natural gas liquefaction system includes: a natural gas storage unit in which natural gas at low pressure and high temperature is stored; a liquefied natural gas storage unit; a body in which liquefied natural gas at high pressure and low temperature, which is a mixed refrigerant supplied from the outside and the natural gas at low pressure and high temperature conveyed from the natural gas storage unit are mixed and heat-exchanged with each other and both gases are converted into liquefied natural gas at medium pressure and medium temperature; a pumping unit compressing and pumping the liquefied natural gas at medium pressure and medium temperature passing through the body into liquefied natural gas at high pressure and medium temperature; a sub-cooling unit sub-cooling the liquefied natural gas at high pressure and medium temperature passing through the pumping unit into liquefied natural gas at high pressure and low temperature; and a first distributing and conveying unit distributing and conveying the liquefied natural gas at high pressure and low temperature passing through the sub-cooling unit to the liquefied natural gas storage unit and the body, so as to allow some of the liquefied natural gas at high pressure and low temperature passing through the sub-cooling unit to be stored in the liquefied natural gas storage unit and supply the remainder to the body as the mixed refrigerant.

The body may include: a first filling unit formed in the body and filled with the liquefied natural gas at high pressure and low temperature conveyed from the first distributing and conveying unit, a second filling unit formed outside the first filling unit and filled with the natural gas at low pressure and high temperature conveyed from the natural gas storage unit, and a spraying nozzle installed at the first filling unit so as to spray the liquefied natural gas at high pressure and low temperature filled in the first filling unit to the second filling unit.

The second filling unit may have a plurality of heat exchanging regions formed by a plurality of guide walls formed therein so as to be spaced apart from each other by a predetermined interval.

The guide walls may be formed in a zigzag shape in the second filling unit.

The second filling unit may have a flow path formed by a plurality of bending walls formed therein so as to be spaced apart from each other by a predetermined interval.

The second filling unit may have a flow path formed in a zigzag shape by the plurality of bending walls formed in the second filling unit so as to be spaced apart from each other by the predetermined interval.

The second filling unit may have a plurality of partition regions formed by a plurality of separation walls formed therein so as to be spaced apart from each other by a predetermined interval and a flow path formed by one or more through holes formed in the separation walls.

The natural gas liquefaction system may further include a non-conversion gas processing unit in communication with the body so as to receive and process a non-converted natural gas at low pressure and high temperature from the body, wherein the body includes a filtering unit installed at a connection portion with the non-conversion gas processing unit so as to filter foreign materials contained in the non-converted natural gas at low pressure and high temperature transferred from the body to the non-conversion gas processing unit and feedback the non-converted natural gas at low pressure and high temperature to the body.

The natural gas liquefaction system may further include a recycle unit installed inside or outside the body and allowing a non-converted natural gas at low pressure and high temperature conveyed from the body to be heat-exchanged with the liquefied natural gas at high pressure and low temperature conveyed from the first distributing and conveying unit, to be converted into liquefied natural gas at medium pressure and medium temperature, and to be then fed back to the body.

The natural gas liquefaction system may further include a second distributing and conveying unit distributing and conveying the liquefied natural gas at high pressure and medium temperature passing through the pumping unit through the body, the sub-cooling unit, the first distributing and conveying unit, and the liquefied natural gas storage unit.

The natural gas liquefaction system may further include: a valve connecting the liquefied natural gas storage unit and the body to each other; and a controlling unit measuring pressure of the body and controlling opening and closing of the valve.

The controlling unit may open the valve so as to allow the liquefied natural gas at high pressure and low temperature stored in the liquefied natural gas storage unit to be conveyed to the body when a pressure measuring value of the body is a reasonable value or more, and close the valve when the pressure measuring value of the body is the reasonable value or less.

Advantageous Effects

Since the natural gas liquefaction system according to the present invention has a body in which the natural gas and the liquefied natural gas are mixed with each other and are heat-exchanged, heat exchange efficiency of the natural gas may be improved.

In addition, since the natural gas liquefaction system according to the present invention has the pumping unit in which the liquefied natural gas is compressed and pumped, energy may be relatively less consumed as compared to the related art in which the natural gas or gas is compressed by the compressor.

In addition, since the natural gas liquefaction system according to the present invention has the sub-cooling unit that sub-cools the liquefied natural gas of a liquid state, sub-cooling efficiency may be further improved as compared to the related art in which the natural gas of a gas state is sub-cooled.

In addition, since the natural gas liquefaction system according to an exemplary embodiment of the present invention further includes a non-conversion gas processing unit linked with the body so as to receive and process the non-converted natural gas at low pressure and high temperature from the body and has a filtering unit installed at a connection portion with the non-conversion gas processing unit so as to filter foreign materials contained in the non-converted natural gas at low pressure and high temperature which is exhausted from the body and feedback the non-converted natural gas at low pressure and high temperature to the body, the non-converted natural gas may be easily processed and cool air contained in the foreign materials may be fed back to the body.

In addition, since the body according to an exemplary embodiment of the present invention has the first filling unit formed in the body and in which the liquefied natural gas at high pressure and low temperature conveyed from the first distributing and conveying unit is filled, a second filling unit formed out of the first filling unit and in which the natural gas at low pressure and high temperature conveyed from the natural gas storage unit is filled, and the spraying nozzle installed at the first filling unit so as to spray the liquefied natural gas at high pressure and low temperature filled in the first filling unit to the second filling unit, heat exchange efficiency of the liquefied natural gas and the natural gas may be maximized.

In addition, since the body according to an exemplary embodiment of the present invention has the plurality of heat exchanging regions formed by the plurality of guide walls formed in the second filling unit, a contact time and a contact space between the natural gas and the liquefied natural gas may be further increased.

In addition, since the body according to an exemplary embodiment of the present invention has the flow channel having a zigzag shape formed by the plurality of bending walls formed in the second filling unit, the contact time and the contact space between the natural gas and the liquefied natural gas may be further increased.

In addition, since the body according to an exemplary embodiment of the present invention has the plurality of partition regions formed by the plurality of separation walls formed in the second filling unit and the flow channel formed by one or more through holes formed by the separation walls, the movement path of the natural gas at low pressure and high temperature which is moved in a state filled in the second filling unit may be freely designated by freely adjusting positions at which the through holes are formed.

In addition, since the natural gas liquefaction system according to an exemplary embodiment of the present invention has the recycle unit, the non-converted natural gas may be again liquefied.

In addition, since the natural gas liquefaction system according to an exemplary embodiment of the present invention has a second distributing and conveying unit that distributes and conveys some of the liquefied natural gas at high pressure and medium temperature passing through the pumping unit to the body, the refrigerant may be easily provided to the body.

In addition, since the natural gas liquefaction system according to an exemplary embodiment of the present invention has the valve connecting the liquefied natural gas storage unit and the body to each other, and the controlling unit measuring pressure of the body and controlling opening and closing of the valve, it is possible to efficiently cope with variation in pressure of the body.

BEST MODE

Hereinafter, a technical spirit of the present invention will be described in more detail with reference to the accompanying drawings.

The accompanying drawings are only examples shown in order to describe the technical idea of the present invention in more detail. Therefore, the technical spirit of the present invention is not limited to shapes of the accompanying drawings.

Figure 1:
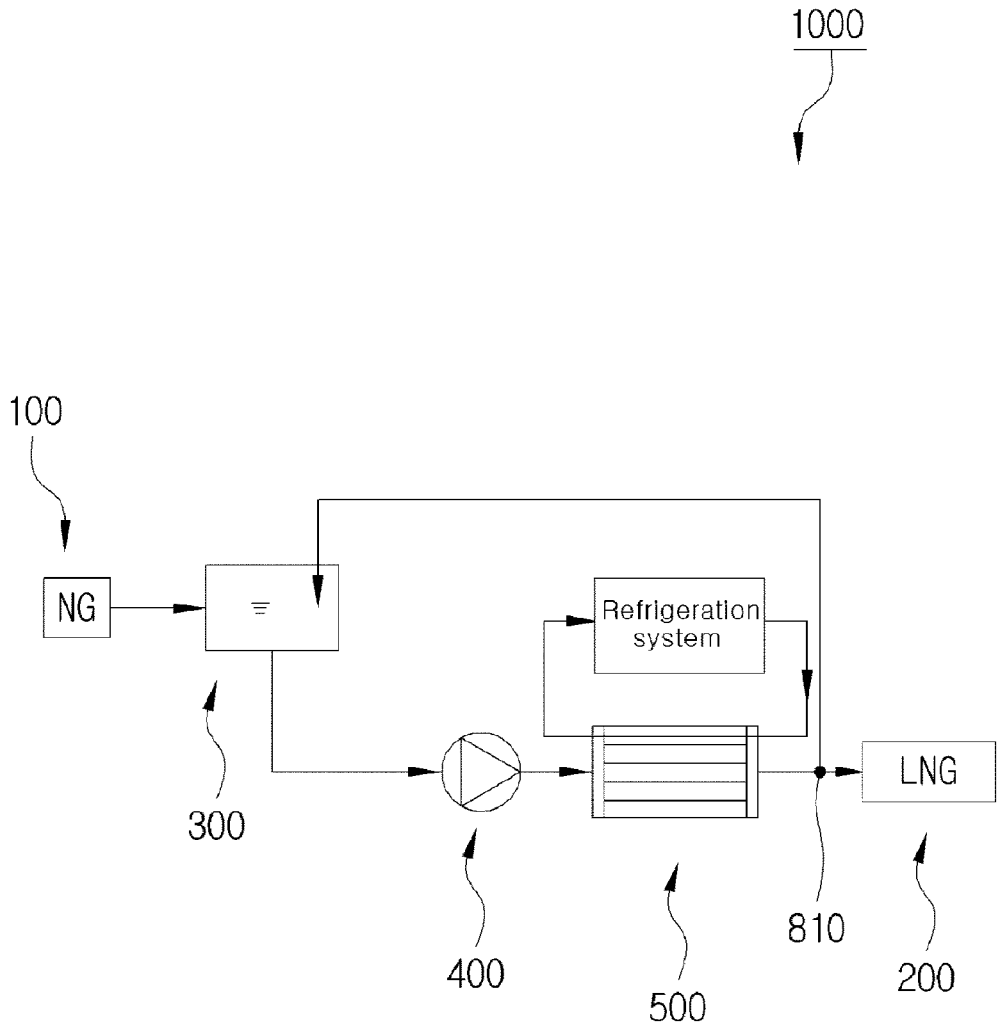
FIG. 1 is a schematic view showing a natural gas liquefaction system according to the present invention.

FIG. 1 is a schematic view showing a natural gas liquefaction system according to the present invention.

As shown in FIG. 1, a natural gas liquefaction system 1000 according to the present invention is configured to include a natural gas storage unit 100, a liquefied natural gas storage unit 200, a body 300, a pumping unit 400, a sub-cooling unit 500, and a first distributing and conveying unit 810.

The natural gas storage unit 100, which is a configuration in which natural gas at low pressure and high temperature is stored, stores extracted natural gas by extracting natural gas of a low pressure and high temperature state buried under the ground or the seabed or boil off gas (BOG) generated from an LNG tank.

As the natural gas storage unit 100, a tank or a vessel known in the art may be used.

As the liquefied natural gas storage unit 200, which is a configuration for storing liquefied natural gas at high pressure and low temperature, a compression tank or a compression vessel known in the art may be used.

The body 300 has a configuration in which the liquefied natural gas at high pressure and low temperature, which is a mixed refrigerant supplied from the outside, and the natural gas at low pressure and high temperature conveyed from the natural gas storage unit 100 are mixed with each other to be heat-exchanged and both gases are converted into liquefied natural gas at medium pressure and medium temperature.

The body 300 has a hollowed space formed therein so that the natural gas at low pressure and high temperature and the liquefied natural gas may be mixed with each other and may be heat-exchanged with each other.

Therefore, since the natural gas liquefaction system 1000 according to the present invention has the body 300 in which the natural gas and the liquefied natural gas are mixed with each other by direct contact and are heat-exchanged, heat exchange efficiency of the natural gas may be improved.

Meanwhile, since the natural gas at low pressure and high temperature introduced into the body 300 is heat-exchanged by the direct contact with the liquefied natural gas at high pressure and low temperature supplied from the outside, it may be more rapidly cooled.

The pumping unit 400 compresses and pumps the liquefied natural gas at medium pressure and medium temperature passing through the body 300 into liquefied natural gas at high pressure and medium temperature.

Therefore, since the natural gas liquefaction system 1000 according to the present invention has the pumping part 400 in which the liquefied natural gas is compressed and pumped, energy may be relatively less consumed as compared to the related art in which the natural gas or gas is compressed by a compressor.

The sub-cooling unit 500 sub-cools the liquefied natural gas at high pressure and medium temperature passing through the pumping unit 400 into liquefied natural gas at high pressure and low temperature.

In this case, the sub-cooling unit 500 sub-cools the liquefied natural gas at high pressure and medium temperature using a refrigeration cycle or a refrigeration system which is known in the art. Since technologies related to the above-mentioned refrigeration cycle or the refrigeration system are widely known, a detailed description thereof will be omitted.

Therefore, since the natural gas liquefaction system 1000 according to the present invention has the sub-cooling part 500 that sub-cools the liquefied natural gas of a liquid state, sub-cooling efficiency may be further improved as compared to the related art in which the natural gas of a gas state is sub-cooled.

The first distributing and conveying unit 810 distributes and conveys the liquefied natural gas at high pressure and low temperature passing through the sub-cooling unit 500 to the liquefied natural gas storage unit 200 and the body 300, so as to store some of the liquefied natural gas at high pressure and low temperature passing through the sub-cooling unit 500 in the liquefied natural gas storage unit 200 and supply the remainder to the body 300 as a mixed refrigerant.

Therefore, since the natural gas liquefaction system 1000 according to the present invention has the first distributing and conveying unit 810 that distributes and conveys some of the liquefied natural gas at high pressure and low temperature passing through the sub-cooling unit 500 to the body 300, it may have a simplified configuration of the system using only the liquefied natural gas as a single refrigerant.

Meanwhile, a principle of liquefying the natural gas by the natural gas liquefaction system 1000 according to the present invention will be described below in detail.

First, in a first operation, the liquefied natural gas at high pressure and low temperature, which is the mixed refrigerant supplied from the outside and the natural gas at low pressure and high temperature conveyed from the natural gas storage unit 100 are each filled in the body 300.

In this case, the body 300 may also be in a state in which a predetermined amount of liquefied natural gas at high pressure and low temperature is filled in the body 300, instead of being supplied with the liquefied natural gas at high pressure and low temperature, which is the mixed refrigerant, from the outside.

Next, in a second operation, the natural gas at low pressure and high temperature and the liquefied natural gas at high pressure and low temperature that are filled in the body 300 are mixed with each other and are heat-exchanged with each other, such that both natural gases are converted into liquefied natural gas at medium pressure and medium temperature.

Next, in a third operation, the liquefied natural gas at medium pressure and medium temperature passing through the body 300 is compressed and pumped into liquefied natural gas at high pressure and medium temperature by the pumping unit 400.

Next, in a fourth operation, the liquefied natural gas at high pressure and medium temperature passing through the pumping unit 400 is sub-cooled into liquefied natural gas at high pressure and low temperature by the sub-cooling unit 500.

Next, in a fifth operation, the liquefied natural gas at high pressure and low temperature passing through the sub-cooling unit 500 is distributed and conveyed to the liquefied natural gas storage unit 200 and the body 300 by the first distributing and conveying unit 810, so as to supply some of the liquefied natural gas at high pressure and low temperature passing through the sub-cooling unit 500 to the body 300 as a refrigerant and store the remainder in the liquefied natural gas storage unit 200.

That is, in the first operation, the mixed refrigerant is the liquefied natural gas at high pressure and low temperature that passes through the sub-cooling unit 500 in the fifth operation and is then supplied to the body 300 by the first distributing and conveying unit 810.

Figure 2:
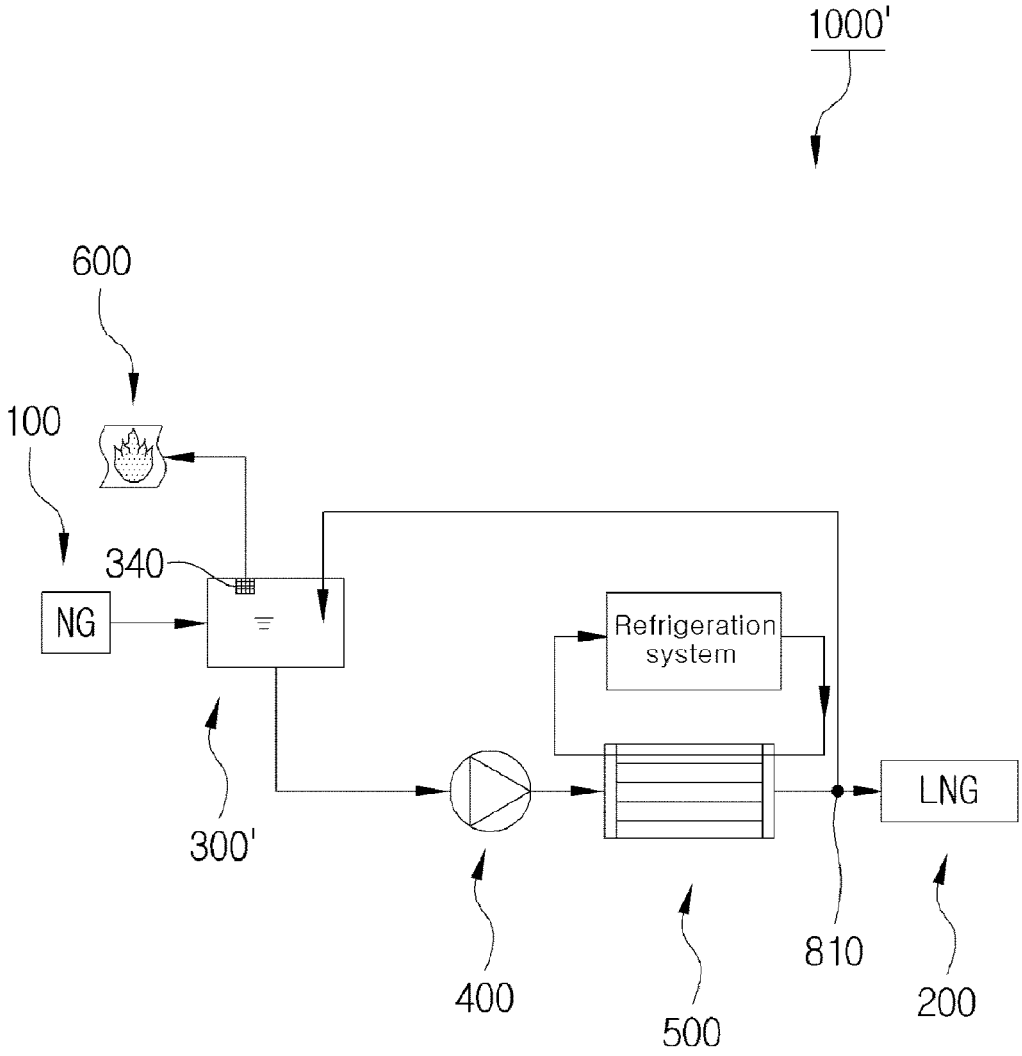
FIG. 2 is a schematic view showing a natural gas liquefaction system according to a first exemplary embodiment of the present invention and an example 1 of a body according to the present invention.

FIG. 2 is a schematic view showing a natural gas liquefaction system according to a first exemplary embodiment of the present invention and an example 1 of a body according to the present invention.

As shown in FIG. 2, a natural gas liquefaction system 1000' according to a first exemplary embodiment of the present invention has a configuration that further includes a non-conversion gas processing unit 600, and an example 1 of a body 300' according to the present invention.

The non-conversion gas processing unit 600, which is a configuration in communication with an upper side of the body 300', receives and processes the natural gas at low pressure and high temperature which is not converted in advance by the body 300', from the body 300'.

In this case, the non-conversion gas processing unit 600 may be configured as a flare stack that burns and removes fluid introduced thereinto.

Here, since the flare stack, which is an apparatus that burns and removes the fluid introduced thereinto is a widely known technology, a detailed description thereof will be omitted.

An example 1 of the body 300' according to the present invention is configured to include a filtering unit installed at a connection portion with the non-conversion gas processing unit 600 and filtering foreign materials (mists) contained in non-converted natural gas at low pressure and high temperature from the body 300' to the non-conversion gas processing unit 600 so as to feedback the non-converted natural gas at low pressure and high temperature to the body 300'.

That is, the filtering unit 340 prevents the foreign materials contained in the non-converted natural gas at low pressure and high temperature from being transferred to the non-conversion gas processing unit 600. This is to prevent the foreign materials containing cool air from being transferred to the non-conversion gas processing unit 600 since the cool air which is heat-exchanged with the liquefied natural gas at high pressure and low temperature remains in the foreign materials.

Therefore, since the natural gas liquefaction system 1000' according to the example 1 of the present invention further includes the non-conversion gas processing unit 600 linked with the body 300' so as to receive and process the non-converted natural gas at low pressure and high temperature from the body 300' and has a filtering unit 340 installed at the connection portion with the non-conversion gas processing unit 600 so as to filter the foreign materials contained in the non-converted natural gas at low pressure and high temperature which is exhausted from the body 300' and feedback the non-converted natural gas at low pressure and high temperature to the body 300', the non-converted natural gas may be easily processed and cool air contained in the foreign materials may be fed back to the body 300'.

Meanwhile, the body may be configured in various shapes so as to increase heat exchange efficiency. A detailed description thereof will be provided below.

Figure 3:
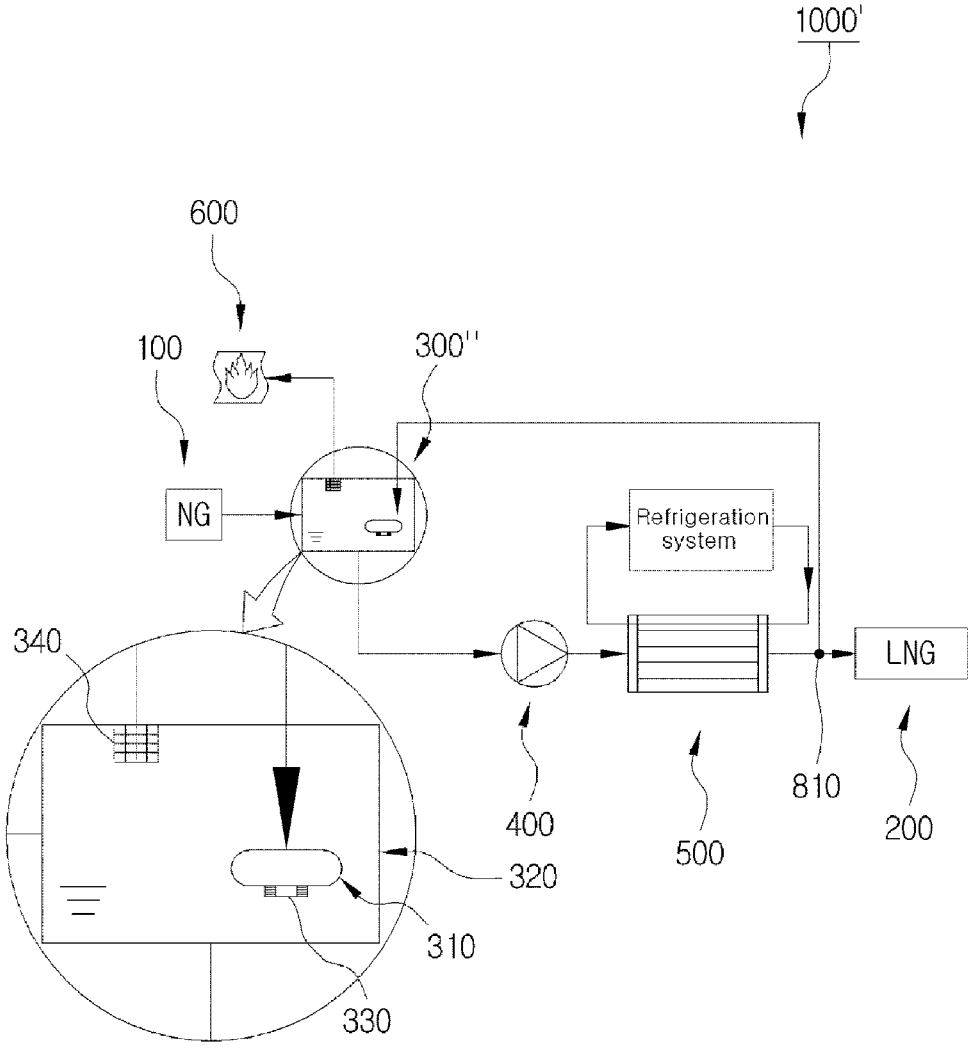
FIG. 3 is a schematic view showing an example 2 of the body according to the present invention.

FIG. 3 is a schematic view showing an example 2 of the body according to the present invention.

As shown in FIG. 3, an example 2 of a body 300" according to the present invention is configured to include a first filling unit 310, a second filling unit 320, a spraying nozzle 330, and a filtering unit 340.

Since the filtering unit 340 is described above, a detailed description thereof will be omitted.

The first filling unit 310, which is an independent space formed in the central portion inside of the body 300", is filled with the liquefied natural gas at high pressure and low temperature conveyed from the first distributing and conveying unit 810.

The second filling unit 320, which is a space formed outside the first filling unit 310, is filled with the natural gas at low pressure and high temperature conveyed from the natural gas storage unit 100.

The spraying nozzle 330 is installed on one end, the other end, or both ends in a horizontal direction of the first filling unit 310 and horizontally sprays the liquefied natural gas at high pressure and low temperature filled in the first filling unit 310, so as to fill the second filling unit 320.

Therefore, since the spraying nozzle 330 fills the second filling unit 320 by horizontally spraying the liquefied natural gas at high pressure and low temperature filled in the first filling unit 310, a contact time between the liquefied natural gas at high pressure and low temperature filled in the first filling unit 310 and the natural gas at low pressure and high temperature filled in the second filling unit 320 becomes longer than a contact time according to a natural drop of the liquefied natural gas at high pressure and low temperature filled in the first filling unit 310, and consequently, heat exchange between the liquefied natural gas at high pressure and low temperature filled in the first filling unit 310 and the natural gas at low pressure and high temperature filled in the second filling unit 320 may be well performed.

Therefore, since the example 2 of the body 300" according to the present invention has the spraying nozzle 330 that horizontally sprays the liquefied natural gas, the contact time between the natural gas and the liquefied natural gas may be increased.

Figure 4:
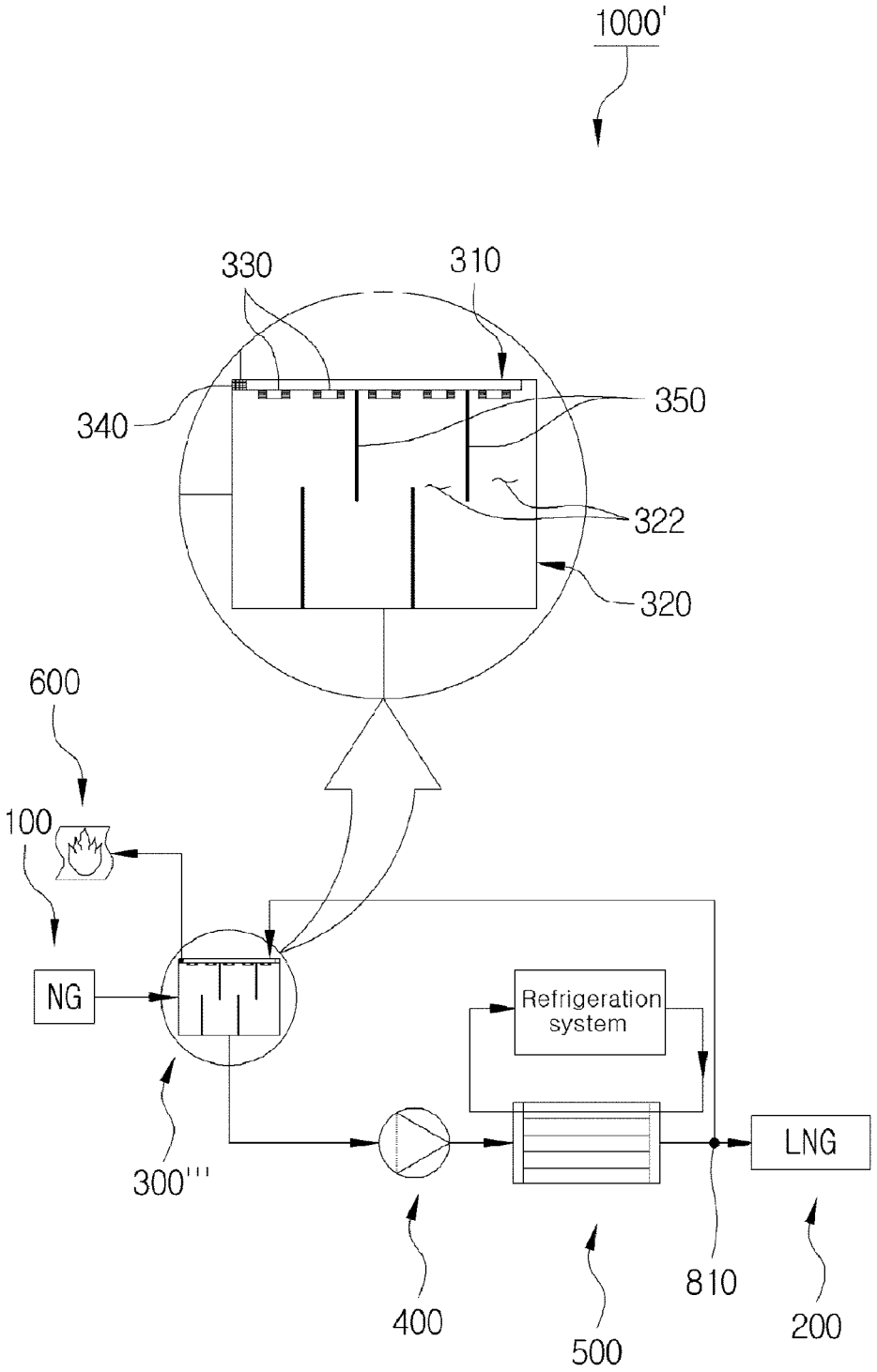
FIG. 4 is a schematic view showing an example 3 of the body according to the present invention.

FIG. 4 is a schematic view showing an example 3 of the body according to the present invention.

As shown in FIG. 4, an example 3 of a body 300''' according to the present invention is configured to include the first filling unit 310, the second filling unit 320, the spraying nozzle 330, the filtering unit 340, and a plurality of guide walls 350.

Since the filtering unit 340 is described above, a detailed description thereof will be omitted.

The first filling unit 310, which is an independent space formed in an upper side in the body 300''', is filled with the liquefied natural gas at high pressure and low temperature conveyed from the first distributing and conveying unit 810.

The second filling unit 320, which is a space formed outside the first filling unit 310, is filled with the natural gas at low pressure and high temperature conveyed from the natural gas storage unit 100.

The plurality of guide walls 350 are formed in a zigzag shape in the second filling unit 320 so as to be spaced apart from each other by a predetermined interval and partition the second filling unit 320 into a plurality of heat exchanging regions 322.

That is, the second filling unit 320 has the plurality of heat exchanging regions 322 formed by the plurality of guide walls 350.

A plurality of spraying nozzles 330 are installed below the first filling unit 310 and horizontally spray the liquefied natural gas at high pressure and low temperature filled in the first filling unit 310, so as to fill the second filling unit 320.

Therefore, since the spraying nozzles 330 fill each of the heat exchanging regions 322 of the second filling unit 320 by horizontally spraying the liquefied natural gas at high pressure and low temperature filled in the first filling unit 310, a contact time between the liquefied natural gas at high pressure and low temperature filled in the first filling unit 310 and the natural gas at low pressure and high temperature each filled in the heat exchanging regions 322 of the second filling unit 320 becomes longer than a contact time according to a natural drop of the liquefied natural gas at high pressure and low temperature filled in the first filling unit 310, and consequently, heat exchange between the liquefied natural gas at high pressure and low temperature filled in the first filling unit 310 and the natural gas at low pressure and high temperature each filled in the heat exchanging regions 322 of the second filling unit 320 may be well performed.

Particularly, since the example 2 of the body 300''' according to the present invention has the plurality of heat exchanging regions 322 formed by the plurality of guide walls 350 formed in the second filling unit 320, a contact time and a contact space between the natural gas and the liquefied natural gas may be increased.

Figure 5:
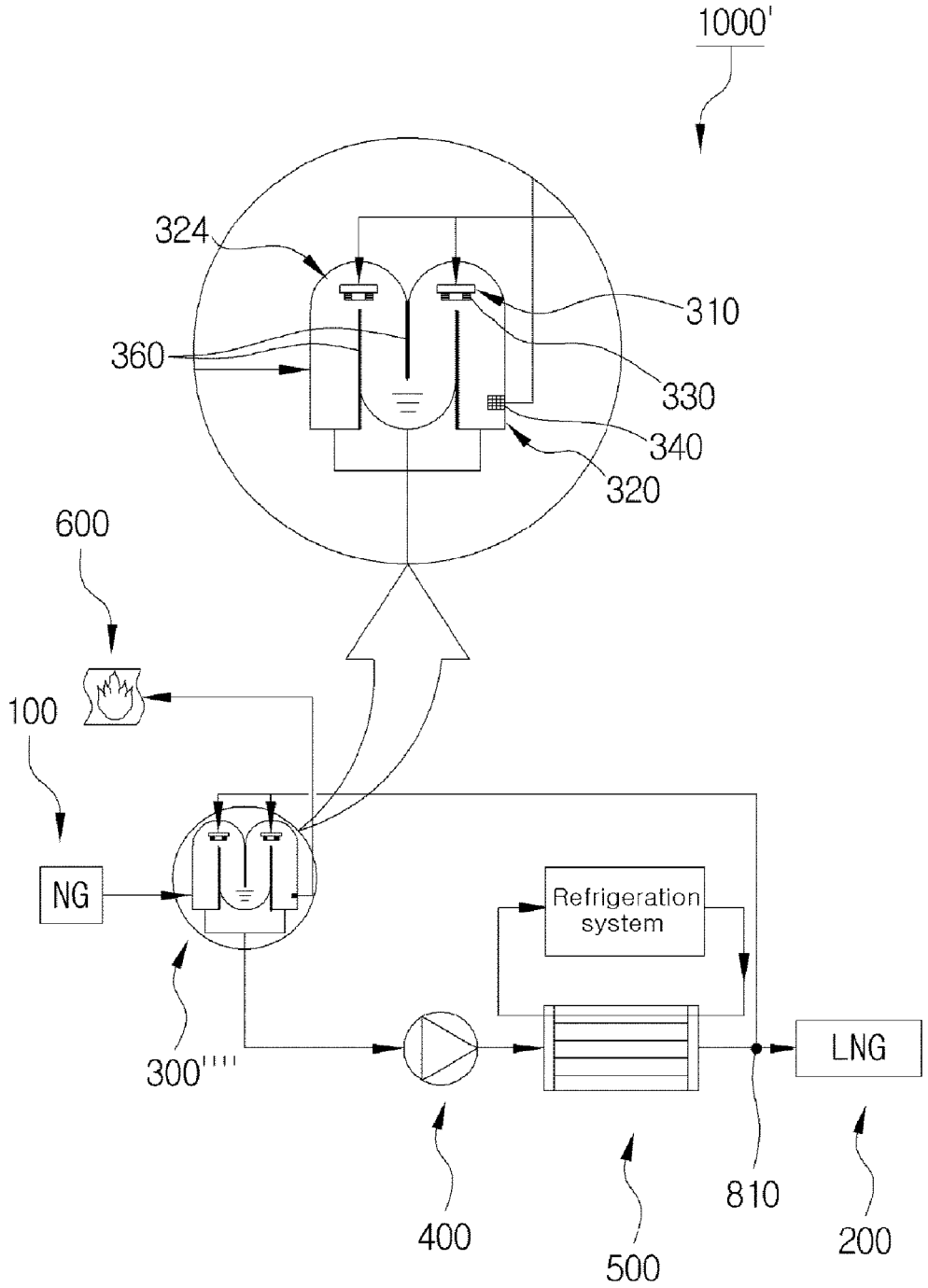
FIG. 5 is a schematic view showing an example 4 of the body according to the present invention.

FIG. 5 is a schematic view showing an example 4 of the body according to the present invention.

As shown in FIG. 5, an example 4 of a body 300'''' according to the present invention is configured to include the first filling unit 310, the second filling unit 320, a plurality of bending walls 360, the spraying nozzle 330, the filtering unit 340.

Since the filtering unit 340 is described above, a detailed description thereof will be omitted.

The first filling unit 310, which is an independent space formed in an upper side in the body 300'''', is filled with the liquefied natural gas at high pressure and low temperature conveyed from the liquefied natural gas storage unit 200.

The second filling unit 320, which is a space formed outside the first filling unit 310, is filled with the natural gas at low pressure and high temperature conveyed from the natural gas storage unit 100.

The plurality of bending walls 360 are formed in a shape bending a pipe in a zigzag shape in the second filling unit 320 so as to be spaced apart from each other by a predetermined interval and form a flow path in the zigzag shape having a plurality of bending regions 324 formed in the second filling unit 320.

That is, the second filling unit 320 is provided with the flow path of the zigzag shape having the plurality of bending regions 324 formed by the plurality of bending walls 360.

A plurality of spraying nozzles 330 are installed below the first filling unit 310 and horizontally spray the liquefied natural gas at high pressure and low temperature filled in the first filling unit 310, so as to fill each of the bending regions 324 of the flow path.

Although FIG. 5 shows an example in which the first filling unit 310 and the spraying nozzles 330 are formed on only the bending regions 324 formed at an upper side of the flow path, the present invention is not limited thereto.

Therefore, since the spraying nozzles 330 fill each of the bending regions 324 of the second filling unit 320 by horizontally spraying the liquefied natural gas at high pressure and low temperature filled in the first filling unit 310, a contact time between the liquefied natural gas at high pressure and low temperature filled in the first filling unit 310 and the natural gas at low pressure and high temperature each filled in the bending regions 324 of the second filling unit 320 becomes longer than a contact time according to a natural drop of the liquefied natural gas at high pressure and low temperature filled in the first filling unit 310, and consequently, heat exchange between the liquefied natural gas at high pressure and low temperature filled in the first filling unit 310 and the natural gas at low pressure and high temperature each filled in the bending regions 324 of the second filling unit 320 may be well performed.

Therefore, since the example 4 of the body 300'''' according to the present invention has the flow path formed by the plurality of bending walls 360 formed in the second filling unit 320, a contact time and a contact space between the natural gas and the liquefied natural gas may be increased.

Figure 6:
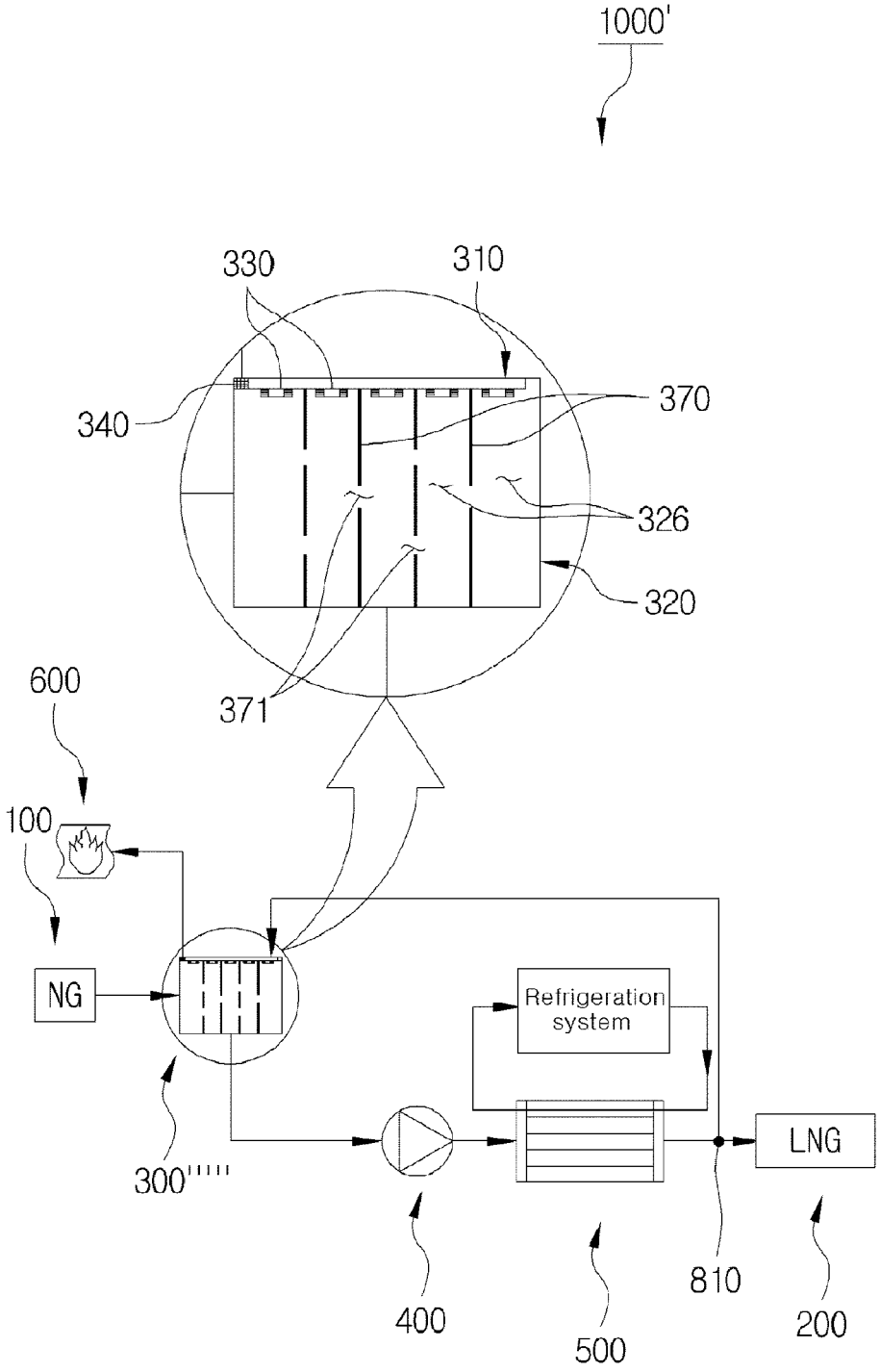
FIG. 6 is a schematic view showing an example 5 of the body according to the present invention.

FIG. 6 is a schematic view showing an example 5 of the body according to the present invention.

As shown in FIG. 6, an example 5 of a body 300'''' according to the present invention is configured to include the first filling unit 310, the second filling unit 320, a plurality of separation walls 370, the spraying nozzle 330, and the filtering unit 340.

Since the filtering unit 340 is described above, a detailed description thereof will be omitted.

The first filling unit 310, which is an independent space formed in an upper side in the body 300'''', is filled with the liquefied natural gas at high pressure and low temperature conveyed from the liquefied natural gas storage unit 200.

The second filling unit 320, which is a space formed outside the first filling unit 310, is filled with the natural gas at low pressure and high temperature conveyed from the natural gas storage unit 100.

The plurality of separation walls 370 are formed in the second filling unit 320 so as to be spaced apart from each other by a predetermined interval and form a plurality of partition regions 326 in the second filling unit 320, wherein one or more through holes 371 are formed in the separation walls 370, so as to form a flow path of a zigzag shape in the second filling unit 320.

A plurality of spraying nozzles 330 are installed below the first filling unit 310 and horizontally spray the liquefied natural gas at high pressure and low temperature filled in the first filling unit 310, so as to fill each of the partition regions 326 of the second filling unit 320.

Therefore, in addition, since the example 5 of the body 300'''' according to the present invention has the plurality of partition regions 326 formed by the plurality of separation walls 370 formed in the second filling unit 320 and has the flow path formed by forming one or more through holes 371 in the separation walls 370, a movement path of the natural gas at low pressure and high temperature which is moved in a state filled in the second filling unit 320 may be freely designated by freely adjusting positions at which the through holes 371 are formed.

Figure 7:
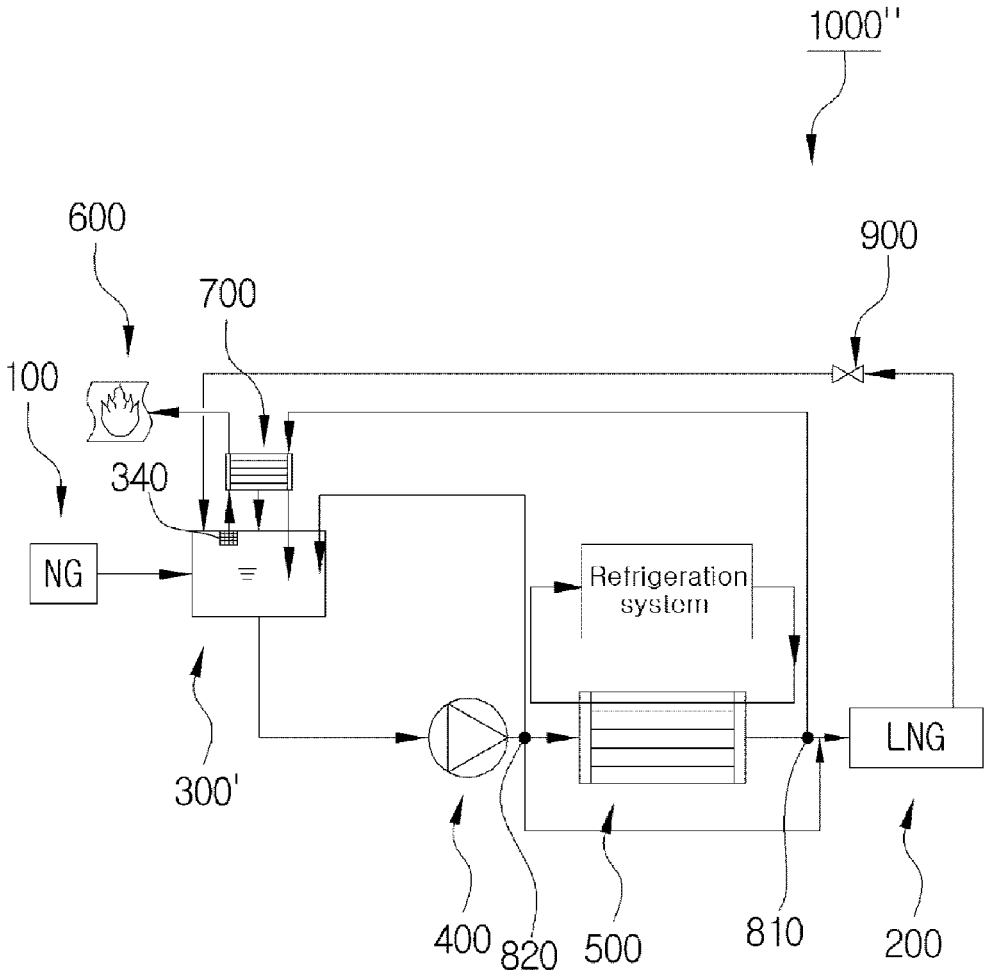
FIG. 7 is a schematic view of a natural gas liquefaction system according to a second exemplary embodiment of the present invention.

FIG. 7 is a schematic view of a natural gas liquefaction system according to a second exemplary embodiment of the present invention.

As shown in FIG. 7, a natural gas liquefaction system 1000" according to a second exemplary embodiment of the present invention has a configuration that further includes a recycle unit 700, a second distributing and conveying unit 820, a valve 900, and a controlling unit, in addition to the natural gas liquefaction system 1000' according to the first exemplary embodiment of the present invention.

In the natural gas liquefaction system 1000" according to the second exemplary embodiment of the present invention, the liquefied natural gas at high pressure and low temperature supplied from the first distributing and conveying unit 810 to the body 300' first passes through the recycle unit 700 and is then supplied to the body 300'.

The recycle unit 700 has a configuration which is installed inside or outside the body 300' and allows the non-converted natural gas at low pressure and high temperature transferred from the body 300' to the non-conversion gas processing unit 600 to be mixed and heat-exchanged with the liquefied natural gas at high pressure and low temperature, which is the mixed refrigerant, supplied from the first distributing and conveying unit 810, to be converted into the liquefied natural gas at medium pressure and medium temperature, and be then fed back to the body 300'.

That is, the recycle unit 700 has the configuration for again liquefying the non-converted natural gas at low pressure and high temperature transferred from the body 300' to the non-conversion gas processing unit 600.

Meanwhile, the non-converted natural gas at low pressure and high temperature which is not converted even by the recycle unit 700 is conveyed to the non-conversion gas processing unit 600.

Therefore, since the natural gas liquefaction system 1000" according to the second exemplary embodiment of the present invention has the recycle unit 700, the natural gas which is not converted by the body 300' in advance may be liquefied again.

The second distributing and conveying unit 820 distributes and conveys the liquefied natural gas at high pressure and medium temperature passing through the pumping unit 400 through the body 300', the sub-cooling unit 500, the first distributing and conveying unit 810, and the liquefied natural gas storage unit 200 so that some of the liquefied natural gas at high pressure and medium temperature passing through the pumping unit 400 is supplied to the body 300' as the refrigerant (the refrigerant for performing the heat exchange with the natural gas at low pressure and high temperature).

Therefore, since the natural gas liquefaction system 1000" according to the second exemplary embodiment of the present invention has the second distributing and conveying unit 820 that distributes and conveys some of the liquefied natural gas at high pressure and medium temperature passing through the pumping unit 400 to the body 300', the refrigerant may be easily provided to the body 300'.

Meanwhile, the liquefied natural gas at high pressure and medium temperature conveyed between the first distributing and conveying unit 810 and the liquefied natural gas storage unit 200 through the second distributing and conveying unit 820 is mixed with the liquefied natural gas at high pressure and low temperature conveyed from the first distributing and conveying unit 810 to the liquefied natural gas storage unit 200, is cooled to the liquefied natural gas at high pressure and low temperature, and is then conveyed to the liquefied natural gas storage unit 200.

In the case in which the liquefied natural gas at high pressure and low temperature passing through the sub-cooling unit 500 is directly conveyed to the liquefied natural gas storage unit 200, since temperature of the liquefied natural gas at high pressure and low temperature passing through the sub-cooling unit 500 is lower than internal temperature of the liquefied natural gas storage unit 200, an inner portion of the liquefied natural gas storage unit 200 may become a vacuum state. However, in the case in which the liquefied natural gas at high pressure and low temperature passing through the sub-cooling unit 500 is conveyed by mixing with the liquefied natural gas at high pressure and medium temperature conveyed between the first distributing and conveying unit 810 and the liquefied natural gas storage unit 200 from the second distributing and conveying unit 820, since the temperature of the liquefied natural gas at high pressure and low temperature passing through the sub-cooling unit 500 is increased, it is possible to prevent the inner portion of the liquefied natural gas storage unit 200 from becoming the vacuum state.

The valve 900, which is configured to connect the liquefied natural gas storage unit 200 and the body 300' to each other, is configured as a solenoid valve that is opened and closed according to a control of the controlling unit.

The controlling unit continuously measures pressure of the body 300' and controls the opening and closing of the valve 900.

In addition, when a pressure measuring value of the body 300' is a reasonable value or more, the controlling unit opens the valve 900 so as to allow the liquefied natural gas at high pressure and low temperature stored in the liquefied natural gas storage unit 200 to be conveyed to the body 300', and when the pressure measuring value of the body 300' is the reasonable value or less, the controlling unit closes the valve 900.

That is, when the pressure measuring value of the body 300' is the reasonable value or more, the controlling unit opens the valve 900 so as to allow the liquefied natural gas high pressure and low temperature stored in the liquefied natural gas storage unit 200 to be conveyed to the body 300', thereby decreasing the pressure of the body 300'.

A more detail description thereof will be provided below. As the natural gas at low pressure and high temperature of the natural gas storage unit 100 is mostly filled in the body 300', density of the body 300' is increased, thereby increasing the pressure of the body 300'. In this case, if the liquefied natural gas at high pressure and low temperature of the liquefied natural gas storage unit 200 is injected into the body 300', the natural gas at low pressure and high temperature which is filled in the body 300' is converted into the natural gas at medium pressure and medium temperature while the density of the body 300' is decreased, thereby decreasing the pressure of the body 300'.

Therefore, since the natural gas liquefaction system 1000" according to the second exemplary embodiment of the present invention has the valve 900 connecting the liquefied natural gas storage unit 200 and the body 300' to each other, and the controlling unit measuring the pressure of the body 300' and controlling the opening and closing of the valve 900, it is possible to efficiently cope with variation in pressure of the body 300'.

The present invention is not limited to the above-mentioned exemplary embodiments, and may be variously applied, and may be variously modified without departing from the gist of the present invention claimed in the claims.

The invention claimed is:

1. A natural gas liquefaction system comprising:

a natural gas storage unit in which natural gas at low pressure and high temperature is stored;

a liquefied natural gas storage unit;

a body in which liquefied natural gas at high pressure and low temperature, which is a mixed refrigerant supplied from the outside and the natural gas at low pressure and high temperature conveyed from the natural gas storage unit are mixed and heat-exchanged with each other and both gases are converted into liquefied natural gas at medium pressure and medium temperature;

a pumping unit compressing and pumping the liquefied natural gas at medium pressure and medium temperature passing through the body into liquefied natural gas at high pressure and medium temperature;

a sub-cooling unit sub-cooling the liquefied natural gas at high pressure and medium temperature passing through the pumping unit into liquefied natural gas at high pressure and low temperature; and a first distributing and conveying unit distributing and conveying the liquefied natural gas at high pressure and low temperature passing through the sub-cooling unit to the liquefied natural gas storage unit and the body, so as to allow some of the liquefied natural gas at high pressure and low temperature passing through the sub-cooling unit to be stored in the liquefied natural gas storage unit and supply the remainder to the body as the mixed refrigerant.

2. The natural gas liquefaction system of claim 1, wherein the body includes:

a first filling unit formed in the body and filled with the liquefied natural gas at high pressure and low temperature conveyed from the first distributing and conveying unit, a second filling unit formed outside the first filling unit and filled with the natural gas at low pressure and high temperature conveyed from the natural gas storage unit, and a spraying nozzle installed at the first filling unit so as to spray the liquefied natural gas at high pressure and low temperature filled in the first filling unit to the second filling unit.

3. The natural gas liquefaction system of claim 2, wherein the second filling unit has a plurality of heat exchanging regions formed by a plurality of guide walls formed therein so as to be spaced apart from each other by a predetermined interval.

4. The natural gas liquefaction system of claim 3, wherein the guide walls are formed in a zigzag shape in the second filling unit.

5. The natural gas liquefaction system of claim 2, wherein the second filling unit has a flow path formed by a plurality of bending walls formed therein so as to be spaced apart from each other by a predetermined interval.

6. The natural gas liquefaction system of claim 5, wherein the second filling unit has a flow path formed in a zigzag shape by the plurality of bending walls formed in the second filling unit so as to be spaced apart from each other by the predetermined interval.

7. The natural gas liquefaction system of claim 2, wherein the second filling unit has a plurality of partition regions formed by a plurality of separation walls formed therein so as to be spaced apart from each other by a predetermined interval and a flow path formed by one or more through holes formed in the separation walls.

8. The natural gas liquefaction system of claim 1, further comprising a non-conversion gas processing unit in communication with the body so as to receive and process a non-converted natural gas at low pressure and high temperature from the body, wherein the body includes a filtering unit installed at a connection portion with the non-conversion gas processing unit so as to filter foreign materials contained in the non-converted natural gas at low pressure and high temperature transferred from the body to the non-conversion gas processing unit and feedback the non-converted natural gas at low pressure and high temperature to the body.

9. The natural gas liquefaction system of claim 1, further comprising a recycle unit installed inside or outside the body and allowing a non-converted natural gas at low pressure and high temperature conveyed from the body to be heat-exchanged with the liquefied natural gas at high pressure and low temperature conveyed from the first distributing and conveying unit, to be converted into liquefied natural gas at medium pressure and medium temperature, and to be then fed back to the body.

10. The natural gas liquefaction system of claim 1, further comprising a second distributing and conveying unit distributing and conveying the liquefied natural gas at high pressure and medium temperature passing through the pumping unit through the body, the sub-cooling unit, the first distributing and conveying unit, and the liquefied natural gas storage unit.

11. The natural gas liquefaction system of claim 1, further comprising:

a valve connecting the liquefied natural gas storage unit and the body to each other; and a controlling unit measuring pressure of the body and controlling opening and closing of the valve.

12. The natural gas liquefaction system of claim 11, wherein the controlling unit opens the valve so as to allow the liquefied natural gas at high pressure and low temperature stored in the liquefied natural gas storage unit to be conveyed to the body when a pressure measuring value of the body is a reasonable value or more, and closes the valve when the pressure measuring value of the body is the reasonable value or less.

* * * * *